US006951206B2

(12) United States Patent
Kishimoto

(10) Patent No.: US 6,951,206 B2
(45) Date of Patent: Oct. 4, 2005

(54) AUTOMOTIVE FUEL SUPPLY APPARATUS

(75) Inventor: Yuji Kishimoto, Tokyo (JP)

(73) Assignee: Mitusbishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/391,614

(22) Filed: Mar. 20, 2003

(65) Prior Publication Data

US 2003/0192508 A1 Oct. 16, 2003

(30) Foreign Application Priority Data

Apr. 16, 2002 (JP) ..... 2002-113106

(51) Int. Cl.[7] ..... F02M 37/04
(52) U.S. Cl. ..... 123/497; 123/447
(58) Field of Search ..... 123/497, 447, 123/467, 463, 357

(56) References Cited

U.S. PATENT DOCUMENTS

| | | | | |
|---|---|---|---|---|
| 4,481,926 A | * | 11/1984 | Miki et al. | 123/463 |
| 5,218,941 A | * | 6/1993 | Suzuki et al. | 123/478 |
| 5,284,120 A | * | 2/1994 | Fukushima et al. | 123/510 |
| 5,398,655 A | * | 3/1995 | Tuckey | 123/456 |
| 5,471,959 A | * | 12/1995 | Sturman | 123/447 |
| 5,477,833 A | * | 12/1995 | Leighton | 123/497 |
| 5,487,454 A | * | 1/1996 | Klembczyk et al. | 188/298 |
| 5,579,739 A | | 12/1996 | Tuckey et al. | |
| 5,590,631 A | * | 1/1997 | Tuckey | 123/447 |
| 6,279,544 B2 | * | 8/2001 | Rumpf | 123/511 |
| 6,357,423 B1 | * | 3/2002 | Kanno | 123/497 |
| 6,491,029 B2 | * | 12/2002 | Kondou et al. | 123/509 |

FOREIGN PATENT DOCUMENTS

| | | |
|---|---|---|
| DE | 195 10 494 | 9/1996 |
| DE | 196 27 741 | 1/1998 |
| DE | 197 10 299 | 1/1998 |
| DE | 197 01 976 | 7/1998 |
| JP | 56-146053 | 11/1981 |
| JP | 62-165571 A | 7/1987 |
| JP | 63-254294 A | 10/1988 |
| JP | 2-105567 U | 8/1990 |
| JP | 6-507692 A | 9/1994 |
| JP | 09-310661 A | 12/1997 |
| JP | 10-227269 A | 8/1998 |

OTHER PUBLICATIONS

German Office Action dated Aug. 12, 2004 for Official File No. 103 16 855.9–13.

* cited by examiner

*Primary Examiner*—Carl S. Miller
(74) *Attorney, Agent, or Firm*—Sughrue Mion, PLLC

(57) ABSTRACT

A fuel pressure detector and a pressure accumulator are disposed in a fuel distribution line, an engine control apparatus controlling activation of a fuel pump based on output from the fuel pressure detector. The fuel pump is activated at maximum capacity to fill the fuel distribution line with fuel at a controlled pressure controlled by a fuel pressure regulator, then stopped. In this state, fuel accumulated under pressure in the pressure accumulator replenishes the fuel distribution line until fuel pressure inside the fuel distribution line drops to a predetermined value due to fuel injection by fuel injection valves.

11 Claims, 9 Drawing Sheets

AUTOMOTIVE FUEL SUPPLY APPARATUS

BACKGROUND OF THE INVENTION

1. Field of the Invention

The present invention relates to a fuel supply apparatus for an automotive engine and particularly relates to an automotive fuel supply apparatus for reducing engine fuel consumption.

2. Description of the Related Art

FIG. 9 is a schematic diagram showing a general overview of a conventional automotive fuel supply apparatus.

In FIG. 9, a fuel pump 1 is disposed inside a fuel tank 2 and is connected to a fuel injection valve 4 of an engine 5 by a fuel distribution line 3. The fuel pump 1 is provided with: a pump main body portion 1*a*; an electric motor portion 1*b* for driving the pump main body portion 1*a*; and a check valve 1*c* for improving engine starting by keeping a fuel system including the fuel distribution line 3 charged with fuel when the engine 5 is stopped. Furthermore, a switching relay 16 is controlled by a pump control portion 13*a* of an engine control apparatus 13 described below such that a voltage from a battery 15 is applied to the motor portion 1*b* when the engine 5 is running, and an electrical connection between the battery 15 and the motor portion 1*b* is shut off when the engine 5 is stopped.

The fuel injection valve 4 is connected to an intake air manifold 6 of the engine 5, is activated and controlled by the engine control apparatus 13, and supplies fuel to the engine 5.

A fuel pressure regulator 7 is constructed such that a spring chamber 8 and a pressure regulating chamber 9 are partitioned by a diaphragm 10. A regulator spring 8*a* is disposed inside the spring chamber 8 so as to press on the diaphragm 10. The pressure regulating chamber 9 is provided with: a discharge orifice 9*a*; and a valve body 9*b* mounted to the diaphragm 10, for opening and closing the discharge orifice 9*a*. The spring chamber 8 communicates with the intake air manifold 6 upstream from the fuel injection valve 4 through a first branch line 11*a*, and the pressure regulating chamber 9 communicates with the fuel distribution line 3 through a second branch line 11*b*. In addition, the pressure regulating chamber 9 communicates with the fuel tank 2 through the discharge orifice 9*a* and a return line 12.

The engine control apparatus 13 is provided with a pump control portion 13*a* and a fuel computing control portion 13*b*, a required quantity of fuel supply being calculated by the fuel computing control portion 13*b* to control the valve opening time of the fuel injection valve 4 based on the quantity of intake air which the engine 5 has drawn in after making a pressure difference upstream and downstream from the fuel injection valve 4 constant. Here, a "D-Jetronic" method is adopted as the method by which the fuel computing control portion 13*b* calculates the required quantity of fuel supply to the engine, the required quantity of fuel supply being calculated based on pressure inside the intake air manifold 6 measured directly by an intake air manifold pressure detector 14.

Moreover, an air flow sensor may also be mounted to the intake air manifold 6 instead of the intake air manifold pressure detector 14, the required quantity of fuel supply being calculated based on the quantity of intake air per unit time in the engine 5 detected by the air flow sensor (an "L-Jetronic" method).

In the conventional automotive fuel supply apparatus constructed in this manner, fuel conveyed under pressure by the fuel pump 1 is supplied to the fuel injection valve 4 through the fuel distribution line 3. Fuel fed into the fuel distribution line 3 is prevented from flowing back into the fuel tank 2 by the action of the check valve 1*c*. Thus, the fuel distribution line 3 is always charged with fuel, even when the engine 5 is stopped.

The pressure inside the intake air manifold 6 is introduced into the spring chamber 8 through the first branch line 11*a*, and the fuel inside the fuel distribution line 3 is introduced into the pressure regulating chamber 9 through the second branch line 11*b*. When the pressure of the regulator spring 8*a* and the pressure inside the intake air manifold 6 are greater than the pressure inside the pressure regulating chamber 9, the diaphragm 10 is pressed toward the pressure regulating chamber 9 and the valve body 9*b* blocks the discharge orifice 9*a*. When the pressure of the regulator spring 8*a* and the pressure inside the intake air manifold 6 are less than the pressure inside the pressure regulating chamber 9, the diaphragm 10 is pressed toward the spring chamber 8, separating the valve body 9*b* from the discharge orifice 9*a* and permitting fuel to flow back through the discharge orifice 9*a* and the return line 12 to the fuel tank 2. In other words, any fuel supplied to the fuel distribution line 3 other than the fuel supplied to the engine 5 from the fuel injection valve 4 is returned through the return line 12 to the fuel tank 2. Thus, the pressure difference upstream and downstream from the fuel injection valve 4 is kept constant. This pressure difference can be set arbitrarily by adjusting the elastic force of the regulator spring 8*a*.

Now, there is a difference of approximately two orders of magnitude (100 times) in the fuel consumption of the engine 5 per unit time when idling and when at maximum output. Generally, this means that the fuel pump 1 is set to a performance at which a sufficient fuel supply can be maintained at maximum output and is constantly operated at this maximum-output setting. Thus, electric power generated in an alternator (not shown) by driving the engine 5 is consumed wastefully by the fuel pump 1 operating at this maximum-output setting, resulting in the consumption of fuel being increased.

When operating conditions are such that the service region of the engine 5 is only in a low-output region, such as in the 10-mode and 15-mode tests defined by the Japanese Ministry of Land, Infrastructure, and Transport, electric power losses due to the fuel pump 1 are particularly large, accounting for approximately three to four percent in a conventional 1500 cc passenger car.

Next, reduction of fuel pump losses in conventional fuel pump control will be explained with reference to FIG. 10. Moreover, FIG. 10 is a graph explaining the performance of the fuel pump, solid lines representing plots of pump discharge pressure P against pump discharge flow rate Q (P versus Q) and dotted chain lines representing plots of pump discharge pressure P against motor current I (P versus I). In FIG. 10, plots of P versus Q when a drive voltage E of the motor portion 1*b* is 14 V, 12 V, and 10.5 V, respectively, and plots of P versus I when the drive voltage E of the motor portion 1*b* is 14 V and 12 V, respectively, are shown.

First, if the pressure is controlled by the fuel pressure regulator 7 so as to be 0.45 MPa, for example, when the drive voltage is 14V, the fuel pump 1 operates with point A in FIG. 10 as an operating point, discharging 90 l/h of fuel. At this time, the motor current I is at point G on the plot of P versus I, consuming an electric current of 5.4 A, making a consumption of approximately 76 W when converted to electric power.

Generally, automotive engines 5 are multicylinder, and as engine output increases, a plurality of fuel injection valves 4 may open simultaneously, but the number of fuel injection valves 4 which open simultaneously is set to two so that the maximum performance of the fuel pump 1, which introduces losses, does not become needlessly large.

For example, in a 1500 cc four-cylinder engine 5, displacement is 375 cc per cylinder, making the quantity of fuel required for the cylinders to generate maximum torque approximately 0.055 cc, assuming an air-fuel ratio of 12:1. At the same time, if an engine rotational frequency generating maximum output is 6,000 rpm, then injection occurs fifty times per second, requiring 2.75 cc of fuel every second. Consequently, for four cylinders, 11 cc of fuel is required every second. In other words, when operating such that only one fuel injection valve 4 is opened, the maximum required fuel demanded by the engine is approximately 40 l/h. Furthermore, it is necessary for the fuel injection valves 4 to inject 0.055 cc of fuel within five milliseconds in each injection, but when injection capacity is low, injection may take longer than five milliseconds.

Thus, in an instant (when two fuel injection valves 4 open simultaneously), a discharge capacity of approximately 80 l/h is demanded of the fuel pump 1, being twice the maximum required fuel demanded by the engine described above.

In FIG. 10, the point where two fuel injection valves 4 open simultaneously is point B, and the point where one fuel injection valve 4 opens is point C which is half of point B. In other words, when two fuel injection valves 4 open simultaneously, the quantity of flow between point A and point B is discharged from the fuel pump 1 wastefully, consuming energy given by the product of that quantity of flow and the fuel pressure. In addition, when one fuel injection valve 4 opens, the quantity of flow between point A and point C is discharged from the fuel pump 1 wastefully.

When all of the fuel injection valves 4 are closed, the quantity of flow between point A and point D, representing complete discharge, returns to the fuel tank 2, consuming all 76 W of electric energy wastefully.

Thus, it has been proposed that the wasted portion in the quantity of discharge from the fuel pump 1 be reduced by controlling the electric power supplied to the fuel pump 1 in response to the service region of the engine 5.

In a conventional fuel supply apparatus proposed as an improvement, as shown in FIG. 11, a switching relay 16A is controlled such that the voltage (14 V) from the battery 15 is supplied to the motor portion 1*b* directly when output from the engine 5 is at a maximum, and the voltage from the battery 15 is supplied to the motor portion 1*b* through a resistor 17 when operating such that only one fuel injection valves 4 is being opened. Here, the resistor 17 is set such that the drive voltage for the motor portion 1*b* is 12 V, for example, in other words, such that the operating point of the fuel pump 1 is point E.

Because the conventional fuel supply apparatus proposed as an improvement is designed to operate such that the drive voltage for the motor portion 1*b* is switched between 14 V and 12 V by the switching relay 16A, a loss corresponding to the quantity of flow between point A and point E is recovered when only one fuel injection valve 4 is being opened.

However, in the conventional fuel supply apparatus proposed as an improvement, the quantity of flow between point C and point E when one fuel injection valve 4 is open, and between point D and point E when the fuel injection valves 4 are closed is still discharged wastefully by the fuel pump 1, making the recovery of losses insufficient.

As can be seen from the fuel pump characteristics (P versus Q characteristics and P versus I characteristics) in FIG. 10, even if the quantity of discharge from the fuel pump 1 is reduced by forty percent, only a twenty-five percent reduction is achieved in electric energy.

Furthermore, because the voltage (14 V) from the battery 15 is dropped to 12 V by the resistor 17 before being supplied to the motor portion 1*b*, one problem has been that losses due to Joule heat at the resistor 17 arise instead, preventing sufficient reductions in conventional electric energy, and in turn reductions in fuel consumption, from being achieved.

Thus, in order to eliminate losses resulting from Joule heat in the resistor 17, as shown in FIG. 12, it is conceivable for the drive voltage for the motor portion 1*b* to be switched to reduce the mean current by switching the large current flowing from the battery 15 to the motor portion 1*b* using a transistor 18, a method also known as "chopping". However, there are problems with this chopping method such as requiring the use of a large transistor 18 which generates heat, and increasing the scale of circuitry to control the transistor 18, thereby creating a burden when mounted to the engine control apparatus 13. Another problem has been that undesirable emission of radio waves is generated by chopping of the motor current, adversely affecting electronic devices such as radios, etc.

In methods controlling the voltage supplied to the motor portion 1*b* such as those described above, it is necessary to increase the discharge performance of the fuel pump 1 suddenly when two fuel injection valves 4 are opened simultaneously. However, even if the voltage supplied to the fuel pump 1 is increased swiftly, the rotational frequency of the motor cannot rise rapidly due to the inertial force of the motor portion 1*b*. As a result, a delay corresponding to a rise time constant of the motor portion 1*b* occurs. Then, if the quantity of discharge from the fuel pump 1 does not meet the injection quantity demanded by the fuel injection valves 4, pressure inside the fuel distribution line 3 drops due to this delay to an intermediate point F between the plot of P versus Q for the drive voltage of 14 V and the plot of P versus Q for the drive voltage of 12 V. Because the injection quantity is controlled by controlling the valve opening time of the fuel injection valves 4 under conditions where the pressure inside the fuel distribution line 3 is controlled so as to be constant by the fuel pressure regulator 7, if the pressure inside the fuel distribution line 3 drops to point F, the injected quantity of fuel becomes deficient by an amount corresponding to that drop and irregular combustion may arise, giving rise to problems such as knocking, etc.

For that reason, even when the engine should normally operate at point E, the operating range must be expanded to allow operation at point A, preventing sufficient loss reductions from being achieved.

SUMMARY OF THE INVENTION

The present invention aims to solve the above problems and an object of the present invention is to provide an automotive fuel supply apparatus enabling reduction of electric power loss by suppressing wasted fuel pump discharge and enabling prevention of the occurrence of electric power loss resulting from Joule heat from a resistor, undesirable emission of radio waves resulting from chopping of a motor current, and irregular combustion resulting from delays corresponding to a rise time constant of a motor portion by accumulating fuel under pressure in a fuel distribution line at a maximum capacity of a fuel pump, then deactivating the fuel pump, and re-activating the fuel pump to accumulate fuel under pressure in the fuel distribution line at a stage when the pressure inside the fuel distribution line falls to a predetermined value.

With the above object in view, an automotive fuel supply apparatus of the present invention includes a fuel pump for conveying fuel under pressure from inside a fuel tank, the fuel pump including a check valve; a fuel distribution line for connecting the fuel pump and a fuel injection valve of an engine; and a fuel pressure regulator connected to the fuel distribution line for controlling fuel pressure in the fuel distribution line so as to be at a controlled pressure. Also provided are a pressure accumulator disposed on the fuel distribution line for accumulating pressure in the fuel conveyed under pressure to the fuel distribution line; a pressure detector for measuring fuel pressure inside the fuel distribution line; and a pump controlling means for controlling activation of the fuel pump in response to output from the pressure detector.

Therefore, provided is an inexpensive automotive fuel supply apparatus enabling electric power losses to be reduced by reducing unnecessary fuel discharge from the fuel pump, and also enabling the suppression of undesirable emission of radio waves and the occurrence of excessive Joule loss.

DETAILED DESCRIPTION OF THE PREFERRED EMBODIMENTS

Preferred embodiments of the present invention will now be explained with reference to the drawings.

Embodiment 1

Figure 1:
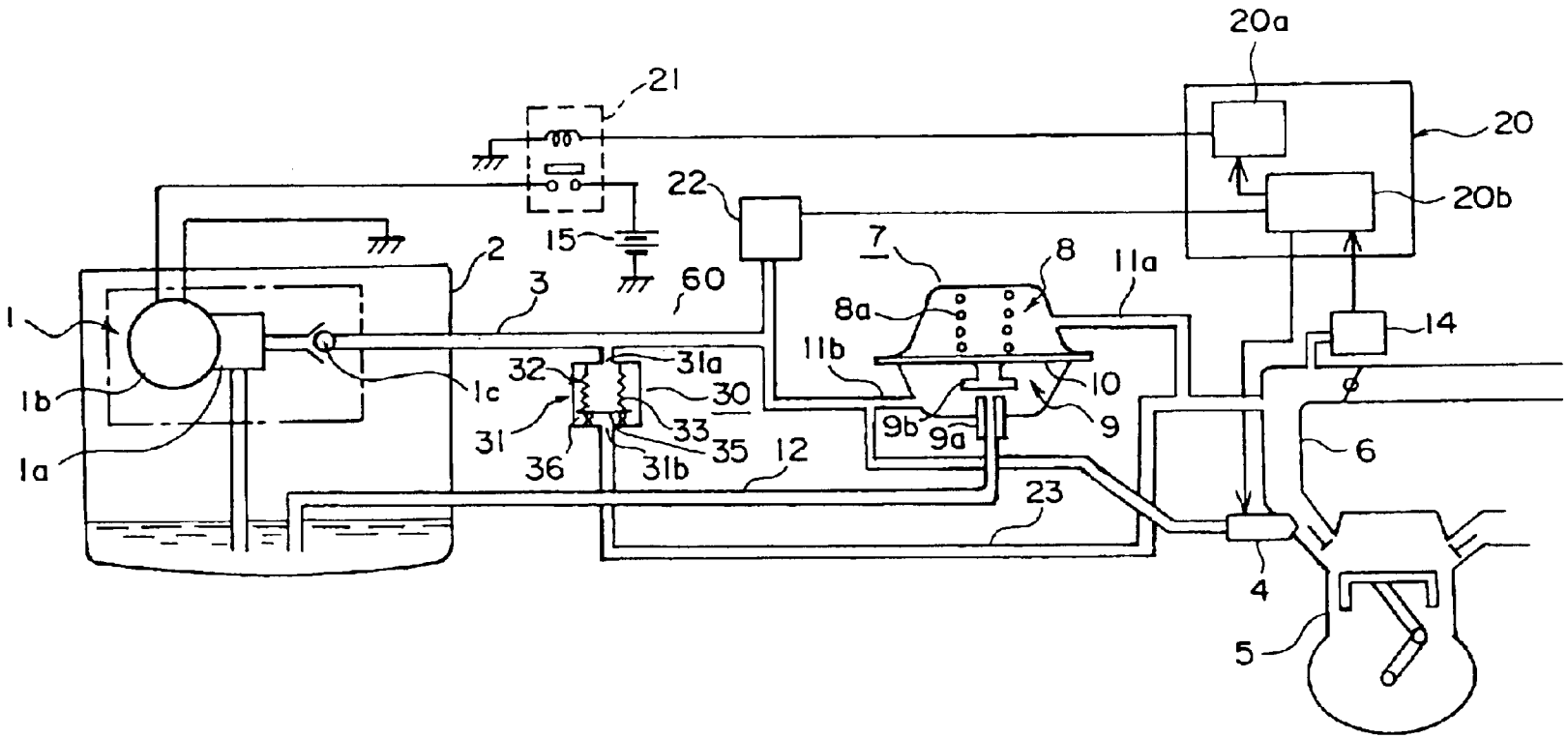
FIG. 1 is a schematic diagram showing a general overview of an automotive fuel supply apparatus according to Embodiment 1 of the present invention.
Figure 2:
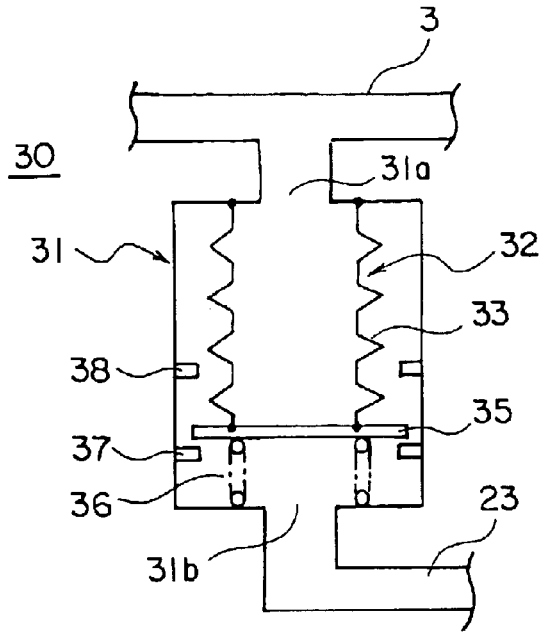
FIG. 2 is a schematic diagram showing a construction of a pressure accumulator of the automotive fuel supply apparatus shown in FIG. 1.
Figure 3:
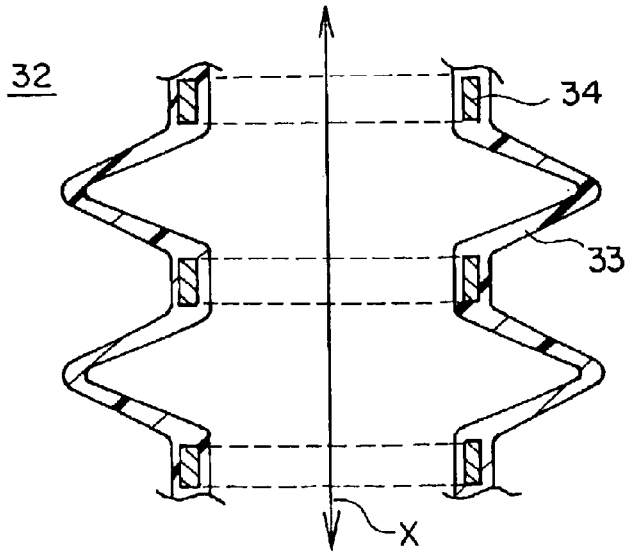
FIG. 3 is a partial enlarged cross section of FIG. 2.

FIG. 1 is a schematic diagram showing a general overview of an automotive fuel supply apparatus according to Embodiment 1 of the present invention, FIG. 2 is a schematic diagram showing a construction of a pressure accumulator of the automotive fuel supply apparatus shown in FIG. 1, and FIG. 3 is a partial enlarged cross section of FIG. 2.

Moreover, in FIG. 1, portions identical to or corresponding to those in the conventional automotive fuel supply apparatuses shown in FIGS. 9, 11, and 12 will be given the same numbering, and explanation thereof will be omitted.

In FIG. 1, an engine control apparatus 20 is provided with a pump control portion 20*a* and a fuel computing control portion 20*b*. A fuel pressure detector 22 is connected to a fuel distribution line 3, detecting the pressure of the fuel inside the fuel distribution line 3 and outputting a pressure detection signal to the engine control apparatus 20. A pressure accumulator 30 is disposed inside an engine compartment 60, and is provided with: a stainless tubular housing 31 in which a first aperture 31*a* and a second aperture 31*b* are disposed; a storage chamber 32 constructed such that an internal volume thereof is expandable and contractable, connected airtightly to an inner wall of the housing 31 so as to communicate with the first aperture 31*a*; and an accumulator spring 36 functioning as a pressure applying means for forcing the storage chamber 32 in a direction of contraction, disposed in a compressed state between a stainless end plate 35 of the storage chamber 32 and a bottom surface of the housing 31. The pressure accumulator 30 is connected to the fuel distribution line 3 through the first aperture 31*a*and communicates with a portion of an intake air manifold 6 upstream from fuel injection valves 4 through the second aperture 31*b* and a communicating line 23.

In this engine control apparatus 20, a required quantity of fuel supply is calculated by the fuel computing control portion 20*b* to control a valve opening time of the fuel injection valves 4 based on the quantity of intake air which the engine 5 has drawn in after making a pressure difference upstream and downstream from the fuel injection valves 4 constant.

This engine control apparatus 20 also functions as a pump controlling means for controlling a switching relay 21 such that a power supply to a motor portion 1*b* of a fuel pump 1 is stopped by the pump control portion 20*a* when the pressure inside the fuel distribution line 3 is a first set pressure $P_1$, and the power supply to the motor portion 1*b* is started when the pressure inside the fuel distribution line 3 is a second set pressure $P_2$. Here, the relationship among the first set pressure $P_1$, the second set pressure $P_2$, and a controlled pressure $P_0$ inside the fuel distribution line 3 controlled by the fuel pressure regulator 7 is such that $P_0$ is less than $P_1$ and greater than $P_2$ ($P_1>P_0>P_2$).

In addition, this engine control apparatus 20 functions as a fuel correcting means for controlling the valve opening time of the fuel injection valves 4 so as to obtain a required quantity of fuel supply by calculating the required quantity of fuel supply to the engine based on a pressure difference between fuel pressure inside the fuel distribution line 3 obtained based on output from the fuel pressure detector 22 and pressure inside the intake air manifold 6 obtained based on output from an intake air manifold pressure detector 14.

Figure 9:
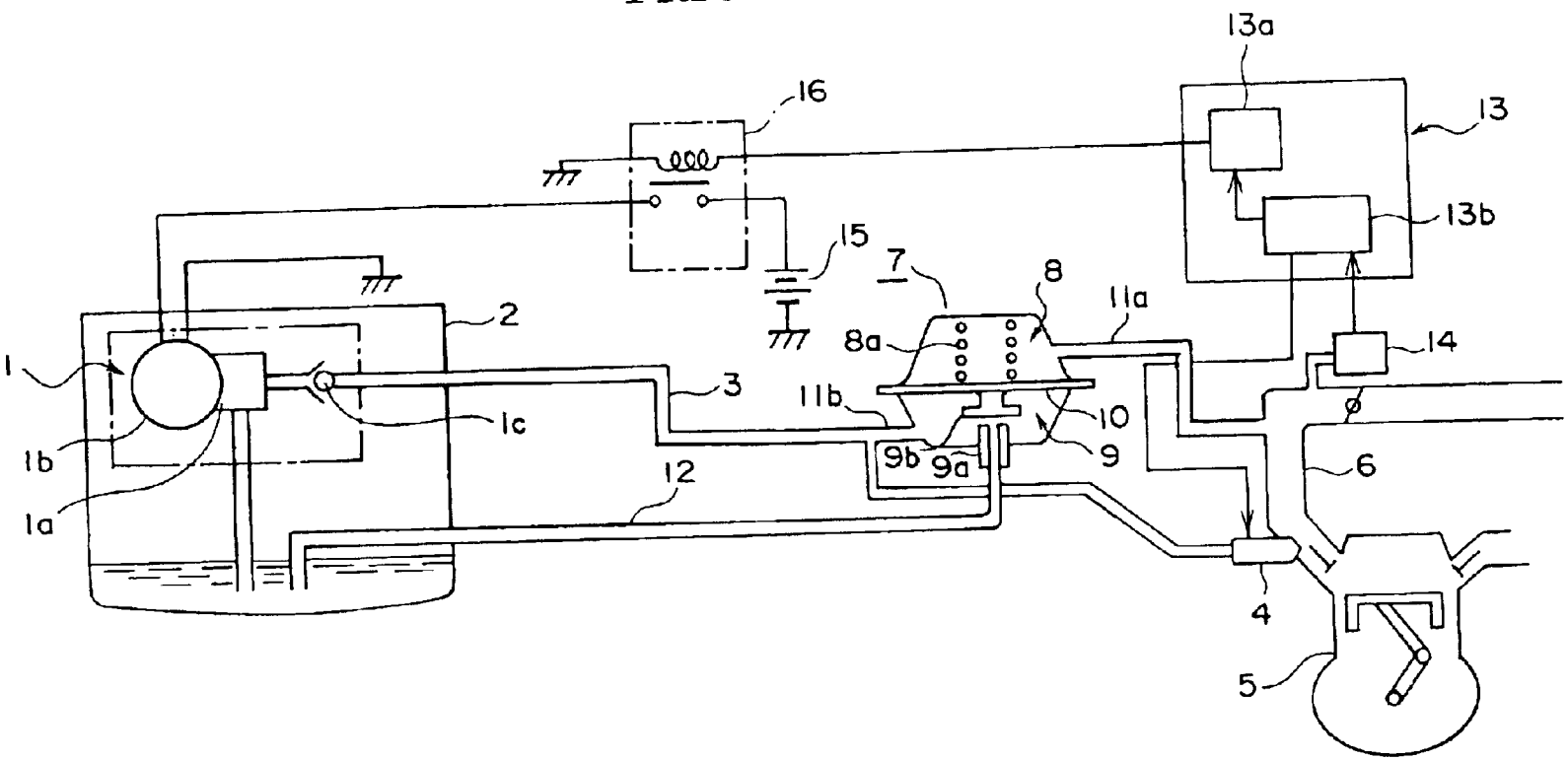
FIG. 9 PRIOR ART
FIG. 9 is a schematic diagram showing a general overview of a conventional automotive fuel supply apparatus.
Figure 11:
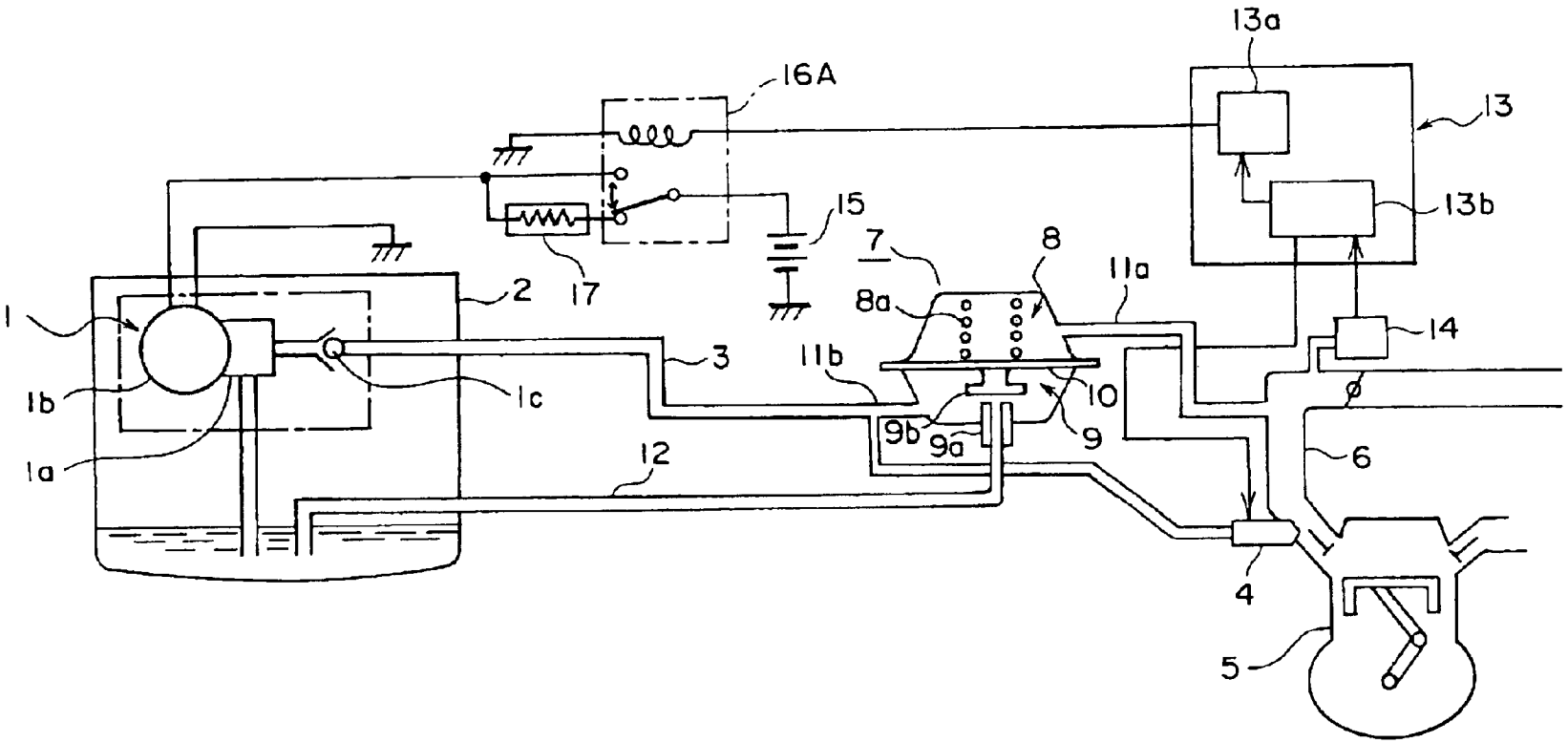
FIG. 11 PRIOR ART
FIG. 11 is a schematic diagram showing a general overview of a conventional automotive fuel supply apparatus proposed as a first improvement.
Figure 12:
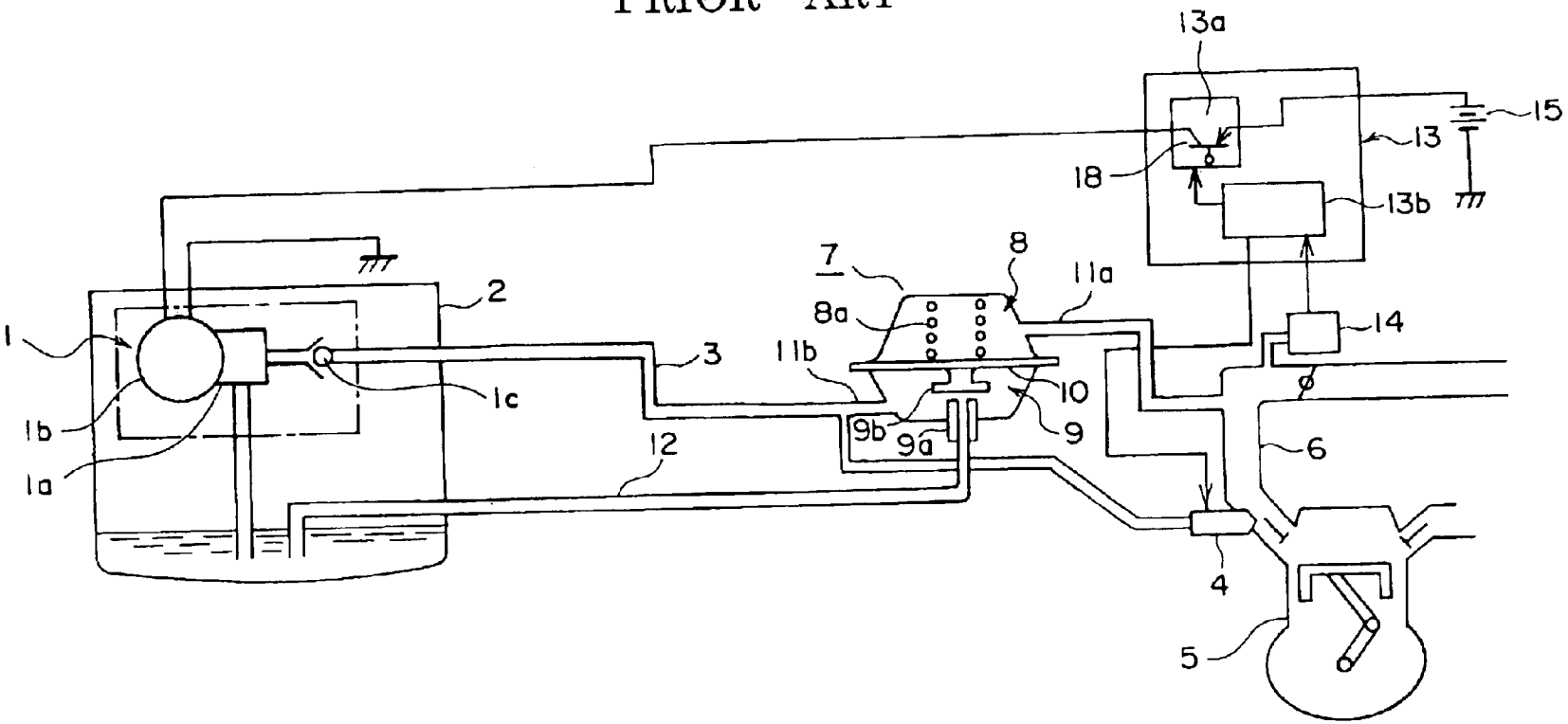
FIG. 12 PRIOR ART
FIG. 12 is a schematic diagram showing a general overview of a conventional automotive fuel supply apparatus proposed as a second improvement.

Moreover, the rest of this embodiment is constructed in a similar manner to the conventional automotive fuel supply apparatuses shown in FIGS. 9, 11, and 12.

A construction of the pressure accumulator 30 will now be explained with reference to FIGS. 2 and 3.

The storage chamber 32 includes: a tubular partition wall 33 formed into a concertina shape using a nitrile rubber (nitrile-butadiene rubber, NBR); stainless metal rings 34 embedded at predetermined positions in the partition wall 33; and a disk-shaped end plate 35 mounted airtightly to a second end of the partition wall 33, a first end of the partition wall 33 being mounted airtightly to an inner wall of the housing 31. The metal rings 34 are molded integrally during molding of the partition wall 33.

Because the partition wall 33 is composed of a nitrile rubber and the metal rings 34 are composed of a stainless alloy, the modulus of elasticity of the partition wall 33 is much less than that of the metal rings 34. A plurality of the metal rings 34 are installed so as to be concentric with a central axis of the partition wall 33 and line up in a central axial direction. Thus, the metal rings 34, in which the modulus of elasticity is large, function so as to prevent radial expansion and contraction of the partition wall 33 by the fuel supplied to the fuel distribution line 3. At the same time, the partition wall 33, in which the modulus of elasticity is small, functions so as to expand and contract. The partition wall 33 is mounted such that the central axis of the partition wall 33 is aligned with a central axis of the housing 31. Thus, expansion and contraction of the internal volume of the storage chamber 32 is achieved by the partition wall 33 expanding and contracting in a central axial direction of the storage chamber 32 due to the pressure of the fuel supplied to the fuel distribution line 3. In other words, the direction of expansion and contraction X of the storage chamber 32 is aligned with the central axis of the housing 31. Thus, the expansion and contraction operation of the storage chamber 32 tracks pressure fluctuations in the fuel swiftly without interference between the partition wall 33 and inner wall surfaces of the housing 31 or between the end plate 35 and the inner wall surfaces of the housing 31.

In addition, a first stopper 37 and a second stopper 38 are disposed so as to protrude from the inner wall of the housing 31, each engaging the end plate 35 to regulate an expansion stopping position (a position of maximum expansion) and a contraction stopping position (a position of minimum contraction), respectively, of the storage chamber 32. Thus, when the pressure of fuel flowing in through the first aperture 31*a* is greater than the sum of the force of the accumulator spring 36 and the pressure inside the communicating line 23, the storage chamber 32 expands until the end plate 35 is placed in contact with the first stopper 37, regulating the position of maximum expansion of the storage chamber 32. On the other hand, when the pressure of fuel flowing in through the first aperture 31*a* is less than the sum of the force of the accumulator spring 36 and the pressure inside the communicating line 23, the storage chamber 32 contracts until the end plate 35 is placed in contact with the second stopper 38, regulating the position of minimum contraction of the storage chamber 32.

Next, operation of this automotive fuel supply apparatus will be explained.

First, the pressure in each portion is set as described below. Moreover, in order to keep the explanation simple, the units of pressure "kg/cm$^2$" will be described as "kg".

The pressure $P_a$ inside the intake air manifold 6 of a natural air-intake engine 5 is known to be equal to atmospheric pressure (1 kg) when the engine is at full throttle, and 0.2 kg when engine braking (for example, when traveling downhill). The spring pressure of the regulator spring 8*a* regulating the controlled pressure $P_0$ inside the fuel distribution line 3 controlled by the fuel pressure regulator 7 is set to 3.5 kg. Thus, the controlled pressure $P_0$ inside the fuel distribution line 3 is controlled so as to be constant between 3.7 kg and 4.5 kg depending on the state of the engine 5.

The first set pressure $P_1$ is (3.6 kg+$P_a$), and the second set pressure $P_2$ is (2.5 kg+$P_a$). For example, when the pressure $P_a$ inside the intake air manifold 6 is 1 kg, $P_1$=4.6 kg and $P_2$=3.5 kg.

In addition, the accumulator spring 36 is set such that the spring pressure is 3 kg at the position of maximum expansion of the storage chamber 32, and 2.5 kg at the position of minimum contraction.

In order to keep the explanation brief, a case in which the pressure $P_a$ inside the intake air manifold 6 is 1 kg will now be explained.

First, as an initial state, when the engine 5 has been stopped for a long time, the pressure of fuel filling the fuel distribution line 3 drops to approximately atmospheric pressure (1 kg) due to a very small amount of fuel leakage from the check valve 1*c*. When the fuel pump 1 is activated at 14 V in this state, the fuel pressure inside the fuel distribution line 3 starts to rise toward the pump shutoff pressure since the entire fuel system including the fuel distribution line 3 is closed. At the same time, in the fuel pressure regulator 7, the 1 kg pressure (atmospheric pressure) inside the intake air manifold 6 is introduced into the spring chamber 8, and because the spring pressure of the regulator spring 8*a* is set to 3.5 kg, the controlled pressure $P_0$ inside the fuel distribution line 3 controlled by the fuel pressure regulator 7 is 4.5 kg. Thus, when the fuel pressure inside the fuel distribution line 3 exceeds 4.5 kg (the controlled pressure $P_0$) controlled by the fuel pressure regulator 7, fuel flows back through the pressure regulating chamber 9 and the return line 12 to the fuel tank 2. Thus, the fuel pressure inside the fuel distribution line 3 is controlled so as to be 4.5 kg.

At the same time, in the pressure accumulator 30, fuel at 4.5 kg flows into the storage chamber 32 through the first aperture 31*a*. Then, because 4.5 kg (the fuel pressure) is greater than 3 kg (the spring pressure of the accumulator spring 36 at the position of maximum expansion of the storage chamber 32)+1 kg (the pressure $P_a$ inside the intake air manifold 6 introduced through the communicating line 23), the storage chamber 32 is filled with fuel at a fuel pressure of 4.5 kg, and expands to the position of maximum expansion.

When a fluid flows along a channel, pressure loss is known to occur due to channel resistance, etc. This pressure loss is proportional to the square of the flow velocity as expressed in Bernoulli's theorem, for example. Thus, when the quantity of flow of fuel flowing back through the pressure regulating chamber 9 and the return line 12 to the fuel tank 2 increases, the fuel pressure inside the fuel distribution line 3 rises. Then, the engine control apparatus 20 monitors the fuel pressure inside the fuel distribution line 3 based on the output from the fuel pressure detector 22, and when it detects that the fuel pressure has exceeded 4.6 kg (the first set pressure $P_1$), the switching relay 21 is switched off by means of the pump control portion 20*a*, stopping the fuel pump 1.

The fuel computing control portion 20*b* calculates the required quantity of fuel supply to the engine 5 based on the output from the intake air manifold pressure detector 14, and the engine control assembly 20 supplies fuel to the engine 5 by controlling opening and closing of the fuel injection valves 4. Because fuel is incompressible, the fuel pressure inside the fuel distribution line 3 suddenly drops due to fuel injection from the fuel injection valves 4. When the fuel pressure inside the fuel distribution line 3 drops below 4.0 kg (a third set pressure), the fuel filling the storage chamber 32 of the pressure accumulator 30 is pressed by the accumulator spring 36 and the pressure inside the intake air manifold 6 introduced through the communicating line 23 and is pushed out into the fuel distribution line 3 with the contraction of the storage chamber 32. If the opening and closing of the fuel injection valves 4 is continued in this state, fuel from inside the storage chamber 32 replenishes the fuel distribution line 3 to compensate for the decrease in fuel due to injection for each fuel injection from the fuel injection valves 4. For example, in a 1500 cc four-cylinder engine, the quantity of fuel supply to each cylinder in each injection is approximately 0.010 cc to 0.055 cc, and a quantity corresponding to this quantity of fuel supply is replenished from the storage chamber 32 to the fuel distribution line 3 for each injection.

Now, if the quantity of effective storage in the storage chamber 32 from the position of minimum contraction to the position of maximum expansion is set to 500 cc, the pressure accumulator 30 can store fuel under pressure corresponding to the quantity of fuel supply for about 9000 injections. This quantity of accumulated pressure corresponds to a quantity enabling the fuel pump 1 to be stopped for 45 seconds when the engine 5 is operating at 6000 rpm (i.e., at maximum output). However, this only corresponds to a quantity enabling the fuel pump 1 to be stopped for 30 seconds if the amount of time that any two fuel injection valves 4 are open simultaneously is 50 percent, and for 22.5 seconds if it is 100 percent.

In this manner, the fuel pressure inside the fuel distribution line 3 decreases to 3.5 kg at a rate corresponding to the operating conditions of the engine 5. While the fuel pressure inside the fuel distribution line 3 is decreasing in this manner, the engine control assembly 20 monitors the fuel pressure inside the fuel distribution line 3 based on the output from the fuel pressure detector 22 and monitors the pressure inside the intake air manifold 6 based on the output from the intake air manifold pressure detector 14, performing fuel pressure corrections to change the valve opening time of the fuel injection valves 4 depending on the pressure difference upstream and downstream from the fuel injection valves 4. In other words, as the pressure difference between the fuel pressure inside the fuel distribution line 3 and the intake air manifold 6 becomes smaller, the valve opening time of the fuel injection valves 4 is lengthened to ensure the required quantity of fuel supply to the engine 5.

When the engine control apparatus 20 detects that the fuel pressure inside the fuel distribution line 3 is 3.5 kg, the switching relay 21 is switched on by means of the pump control portion 20*a*, activating the fuel pump 1. Because the discharge capacity of the fuel pump 1 is 90 l/h (point A in FIG. 10), it takes 20 seconds to restore the initial state in which the 500 cc quantity of effective storage of the storage chamber 32 of the pressure accumulator 30 is filled with fuel at a fuel pressure of 4.5 kg.

Up to this point, a case in which the pressure $P_a$ inside the intake air manifold 6 is atmospheric pressure (1 kg) has been explained, but because the pressure inside the intake air manifold 6 is introduced into the fuel pressure regulator 7 and the pressure accumulator 30, it is clear that the present invention will also operate in a similar manner in cases where the pressure inside the intake air manifold 6 is other than atmospheric pressure.

Furthermore, it goes without saying that the set pressures for each type of pressure are not limited to these values and may be set appropriately for each of various applications.

Figure 10:
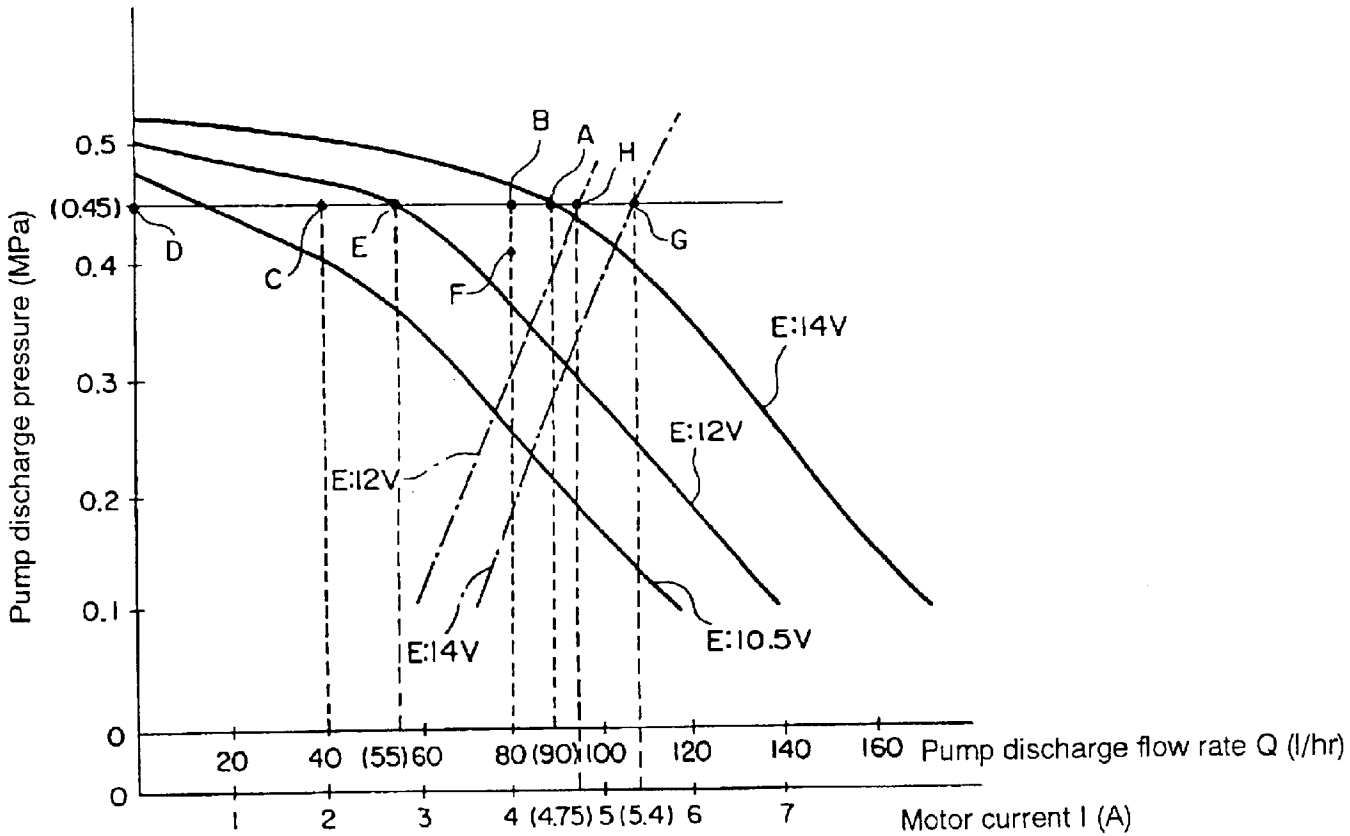
FIG. 10 is a graph explaining pumping characteristics of a fuel pump.

The fuel consumed in the 10-mode and 15-mode tests representing inner-city operation is 300 cc in a 1500 cc automobile, the elapsed time therein being 660 seconds. If the present automotive fuel supply apparatus is adopted, the fuel pump 1 only needs to be activated for 10 seconds while running the 10-mode and 15-mode tests. Thus, as shown in FIG. 10, the motor current which constantly consumed 4.5 A can be reduced to a mean value of 0.16 A, enabling significant reductions in the fuel consumed.

Thus, in Embodiment 1, because the pressure accumulator 30 is disposed on the fuel distribution line 3, and fuel is accumulated under pressure in the pressure accumulator 30 at the maximum capacity of the fuel pump 1, and then the fuel pump 1 is stopped, it is no longer necessary for the fuel pump 1 to discharge fuel beyond the injection quantity required by the engine 5, enabling maximum reductions in electric power loss.

Because the fuel pressure detector 22 is disposed in the fuel distribution line 3, and activation of the fuel pump 1 is stopped when the fuel pressure inside the fuel distribution line 3 is a first set pressure $P_1$ exceeding the controlled pressure $P_0$ inside the fuel distribution line 3 controlled by the fuel pressure regulator 7, and the fuel pump 1 is activated at a second set pressure $P_2$ which is less than the controlled pressure $P_0$, activation of the fuel pump 1 is a simple ON/OFF activation, enabling the switching relay 21 to be constructed inexpensively and also enabling the suppression of undesirable emission of radio waves and the occurrence of excessive Joule heat. Frequency of use of the motor portion 1*b* is also reduced significantly, enabling the service life of the fuel pump 1 to be extended and also enabling a quieter automobile to be achieved.

Because the fuel pump 1 is reactivated while fuel is being supplied to the fuel distribution line 3 from the pressure accumulator 30, even if a delay occurs due to the startup characteristics of the motor portion 1*b* of the fuel pump 1, the injection quantity from the fuel injection valves 4 will not be deficient.

Because fuel pressure corrections to change the valve opening time of the fuel injection valves 4 depending on the pressure difference upstream and downstream from the fuel injection valves 5 are performed while the fuel pressure inside the fuel distribution line 3 is dropping after stopping the fuel pump 1, the required quantity of fuel supply to the engine 5 is ensured, enabling accurate air-fuel ratio control to be performed, thereby enabling the occurrence of knocking, etc., resulting from the occurrence of irregular combustion to be prevented.

Because a plurality of metal rings 34 are embedded in the partition wall 33 of the storage chamber 32 so as to be concentric with the central axis of the concertinaed, cylindrical partition wall 33 and to line up in a central axial direction, and the modulus of elasticity of the metal rings 34 is greater than the modulus of elasticity of the partition wall 33, radial expansion and contraction of the storage chamber 32 is regulated by the metal rings 34, achieving expansion and contraction of the internal volume of the storage chamber 32 by the partition wall 33 expanding and contracting in a central axial direction of the storage chamber 32. Thus, interference between the storage chamber 32 and the housing 31 is eliminated by substantially aligning the central axes of the storage chamber 32 and the housing 21, enabling the storage chamber 32 to expand and contract swiftly to track fluctuations in the fuel pressure. Hence, delays in the contraction operation of the storage chamber 32 are suppressed, preventing the injection quantity from the fuel injection valves 4 from becoming deficient.

Because first and second stoppers 37 and 38 for regulating a position of maximum expansion and a position of minimum contraction, respectively, in the storage chamber 2 are disposed in the housing 31 of the pressure accumulator 30, the storage chamber 32 expands and contracts between the position of maximum expansion and the position of minimum contraction. Thus, excessive contraction and expansion is suppressed, improving tolerance to repeated use, thereby enabling reliability to be increased.

Because the storage chamber 32 of the pressure accumulator 30 is mounted to the housing 31 airtightly, fuel leakage is suppressed, eliminating constraints on the mounting location of the pressure accumulator 30. Thus, maintenance workability of the pressure accumulator 30 can be improved by installing the pressure accumulator 30 in the engine compartment. Integration with other parts also becomes possible.

Moreover, in Embodiment 1 above, activation of the fuel pump 1 is controlled so as to stop when the fuel pressure inside the fuel distribution line 3 exceeds the first set pressure $P_1$ regardless of the operating state of the engine 5, but the fuel pump 1 may also be operated continuously when the engine 5 is operating at maximum output, because the quantity of fuel discharged from the fuel pump 1 and flowing back wastefully is reduced in that operating state.

Furthermore, in Embodiment 1 above, the first set pressure $P_1$ of the fuel pressure for stopping activation of the fuel pump 1 is explained as being set so as to be greater than the controlled pressure $P_0$ of the fuel pressure controlled by the fuel pressure regulator 7, but the first set pressure $P_1$ may also be set so as to be less than the controlled pressure $P_0$. In that case, the fuel pressure regulator 7 is used as a relief valve.

In Embodiment 1 above, the fuel pressure regulator 7 and the pressure accumulator 30 are constructed as separate parts, but the fuel pressure regulator 7 and the pressure accumulator 30 may also be constructed as an integrated part.

In Embodiment 1 above, the partition wall 33 of the storage chamber 32 of the pressure accumulator 30 is prepared using a nitrile rubber, but it is only necessary for the partition wall 33 to be able to tolerate engine conditions and, for example, an ethylene-propylene rubber (EPDM), or a fluororubber (FKM), etc., can also be used.

In Embodiment 1 above, the storage chamber 32 of the pressure accumulator 30 is explained as being composed of a partition wall 33 and metal rings 34 having two different moduli of elasticity, but the storage chamber 32 may also be composed of members having three or more different moduli of elasticity.

In Embodiment 1 above, first and second stoppers 37 and 38 for regulating a position of maximum expansion and a position of minimum contraction of the storage chamber 32 of the pressure accumulator 30 are explained as being disposed, but the first and second stoppers 37 and 38 may also be omitted. In that case also, the automotive fuel supply apparatus operates in a similar manner.

In Embodiment 1 above, the storage chamber 32 of the pressure accumulator 30 is formed into a cylindrical shape, but the storage chamber is not limited to a cylindrical shape, and for example, may also be formed into a collapsible barrel shape. In that case, the outside diameter of the metal rings need simply be formed sequentially smaller from a central portion of the storage chamber toward one or both axial end portions.

In Embodiment 1 above, the first and second stoppers 37 and 38 are mounted to the inner wall of the housing 31, but the first and second stoppers 37 and 38 may also be mounted to the end plate 35 so as to engage with the bottom surface and a ceiling surface of the housing 31.

Embodiment 2

Figure 4:
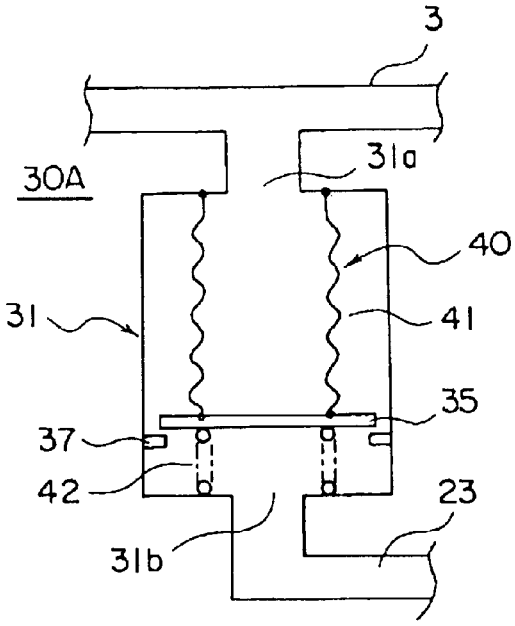
FIG. 4 is a schematic diagram showing a construction of a pressure accumulator of an automotive fuel supply apparatus according to Embodiment 2 of the present invention.

FIG. 4 is a schematic diagram showing a construction of a pressure accumulator of an automotive fuel supply apparatus according to Embodiment 2 of the present invention.

In FIG. 4, a pressure accumulator 30A is provided with: a tubular housing 31 in which a first aperture 31*a* and a second aperture 31*b* are disposed; a storage chamber 40 constructed such that an internal volume thereof is expandable and contractable, connected airtightly to an inner wall of the housing 31 so as to communicate with the first aperture 31*a*; and an accumulator spring 42 functioning as a pressure applying means for forcing the storage chamber 40 in a direction of contraction, disposed in a compressed state between an end plate 35 of the storage chamber 40 and a bottom surface of the housing 31. The pressure accumulator 30A is connected to the fuel distribution line 3 through the first aperture 31*a* and communicates with a portion of an intake air manifold 6 upstream from fuel injection valves 4 through the second aperture 31*b* and a communicating line 23.

The storage chamber 40 is constituted by: a cylindrical corrugated bellows 41 functioning as a partition wall prepared by bending a thin sheet of stainless alloy into a wave shape; and an end plate 35 mounted airtightly to a lower end of the corrugated bellows 41. The corrugated bellows 41 is formed such that a modulus of elasticity in a radial direction (a direction perpendicular to a central axial direction) is larger than a modulus of elasticity in the central axial direction thereof, expansion and contraction of the storage chamber 40 being achieved by expansion and contraction of the corrugated bellows 41 in the central axial direction. A first stopper 37 mounted to an inner wall of the housing 31 engages the end plate 35 to regulate a position of maximum expansion of the storage chamber 40.

The accumulator spring 42 is set such that the sum of the spring pressure when the storage chamber 40 is at the position of maximum expansion and the force of recovery of the corrugated bellows 41 when the storage chamber 40 is at the position of maximum expansion is 3 kg.

Moreover, except for the fact that the pressure accumulator 30A is used instead of the pressure accumulator 30, Embodiment 2 is constructed in a similar manner to Embodiment 1 above.

Next, characteristic portions of the operation of Embodiment 2 will be explained for a case in which the pressure inside the intake air manifold 6 is 1 kg.

First, the fuel distribution line 3 is filled with fuel at the maximum capacity of the fuel pump 1. Activation of the fuel pump 1 is stopped when the engine control apparatus 20 detects that the fuel pressure inside the fuel distribution line 3 has exceeded 4.6 kg. At this time, the storage chamber 40 of the pressure accumulator 30A is filled with fuel at 4.5 kg and at the position of maximum expansion.

Opening of the fuel injection valves 4 is controlled by the engine control apparatus 20 to supply fuel inside the fuel distribution line 3 to the engine 5. The fuel pressure inside the fuel distribution line 3 drops due to this fuel injection. When the fuel pressure inside the fuel distribution line 3 drops to equal to or less than 4 kg (the third set pressure), the fuel accumulated under pressure in the pressure accumulator 30A is supplied to the fuel distribution line 3 to compensate for the decrease due to fuel injection while the storage chamber 40 of the pressure accumulator 30A contracts.

Then, when the engine control apparatus 20 detects that the fuel pressure inside the fuel distribution line 3 is 3.5 kg, the fuel pump 1 is reactivated to return the fuel distribution line 3 and the storage chamber 40 of the pressure accumulator 30A to the initial state filled with fuel at 4.5 kg.

Consequently, similar effects to those in Embodiment 1 above can also be achieved in Embodiment 2.

Moreover, in Embodiment 2 above, the corrugated bellows 41 is prepared using a thin sheet of stainless alloy but the material for the corrugated bellows 41 is not limited to a stainless alloy, provided that it is a material having spring properties and, for example, phosphor bronze, red brass, beryllium copper, etc., can also be used.

Embodiment 3

Figure 5:
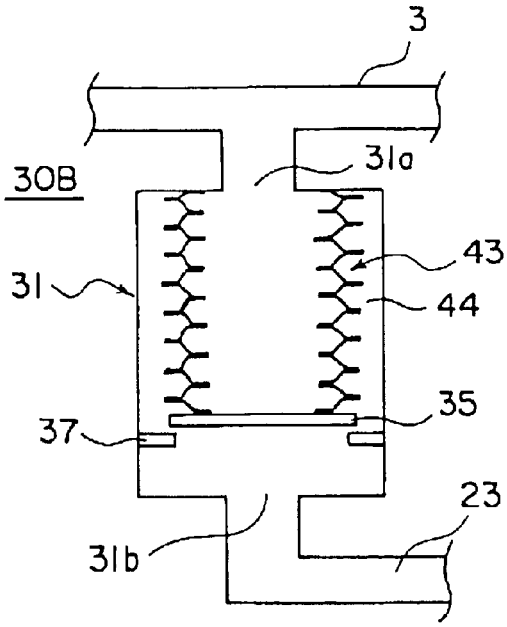
FIG. 5 is a schematic diagram showing a construction of a pressure accumulator of an automotive fuel supply apparatus according to Embodiment 3 of the present invention.
Figure 6:
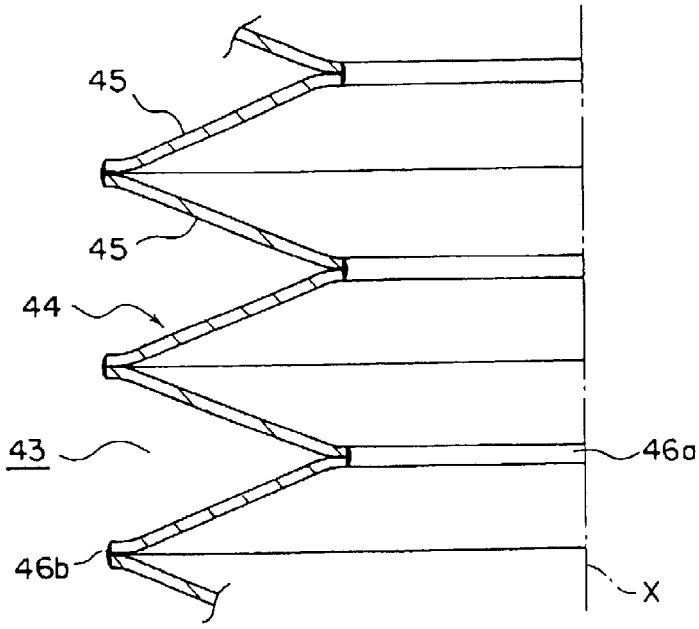
FIG. 6 is a partial enlarged cross section of FIG. 5.

FIG. 5 is a schematic diagram showing a construction of a pressure accumulator of an automotive fuel supply apparatus according to Embodiment 3 of the present invention, and FIG. 6 is a partial enlarged cross section of FIG. 5.

In FIG. 5, a pressure accumulator 30B is provided with: a tubular housing 31 in which a first aperture 31*a* and a second aperture 31*b* are disposed; and a storage chamber 43 constructed such that an internal volume thereof is expandable and contractable, connected airtightly to an inner wall of the housing 31 so as to communicate with the first aperture 31*a*. The pressure accumulator 30B is connected to the fuel distribution line 3 through the first aperture 31*a* and communicates with a portion of an intake air manifold 6 upstream from fuel injection valves 4 through the second aperture 31*b* and a communicating line 23.

The storage chamber 43, as shown in FIG. 6, is constituted by: a welded-disk bellows 44 functioning as a partition wall prepared by laminating thin, disk-shaped flat springs 45 composed of a stainless alloy and airtightly welding adjacent flat springs 45 alternately on an inner circumferential side and an outer circumferential side; and an end plate 35 mounted airtightly to a lower end of the welded-disk bellows 44. Moreover, in FIG. 6, 46*a* indicates an inner circumferential weld portion, and 46*b* an outer circumferential weld portion. The welded-disk bellows 44 is formed such that a modulus of elasticity in a radial direction (a direction perpendicular to a central axis X) is larger than a modulus of elasticity in a central axial direction thereof. Thus, each of the disk-shaped flat springs 45 bends mainly in a central axial direction of the welded-disk bellows 44 in a vicinity of the inner circumferential weld portion 46*a* and the outer circumferential weld portion 46*b*, expansion and contraction of an internal volume of the storage chamber 43 being achieved by the welded-disk bellows 44 expanding and contracting in the central axial direction. A first stopper 37 mounted to an inner wall of the housing 31 engages the end plate 35 to regulate a position of maximum expansion of the storage chamber 43.

The welded-disk bellows 44 is set such that the spring pressure (the force of recovery) when the storage chamber 43 is at the position of maximum expansion is 3 kg.

Moreover, except for the fact that the pressure accumulator 30B is used instead of the pressure accumulator 30, Embodiment 3 is constructed in a similar manner to Embodiment 1 above.

Next, characteristic portions of the operation of Embodiment 3 will be explained for a case in which the pressure inside the intake air manifold 6 is 1 kg.

First, the fuel distribution line 3 is filled with fuel at the maximum capacity of the fuel pump 1. Activation of the fuel pump 1 is stopped when the engine control apparatus 20 detects that the fuel pressure inside the fuel distribution line 3 has exceeded 4.6 kg. At this time, the storage chamber 43 of the pressure accumulator 30B is filled with fuel at 4.5 kg and at the position of maximum expansion.

Opening of the fuel injection valves 4 is controlled by the engine control apparatus 20 to supply fuel inside the fuel distribution line 3 to the engine 5. The fuel pressure inside the fuel distribution line 3 drops due to this fuel injection. When the fuel pressure inside the fuel distribution line 3 drops to equal to or less than 4 kg (the third set pressure), the fuel accumulated under pressure in the pressure accumulator 30B is supplied to the fuel distribution line 3 to compensate for the decrease due to fuel injection while the storage chamber 43 of the pressure accumulator 30B contracts.

Then, when the engine control apparatus 20 detects that the fuel pressure inside the fuel distribution line 3 is 3.5 kg, the fuel pump 1 is reactivated to return the fuel distribution line 3 and the storage chamber 43 of the pressure accumulator 30B to the initial state filled with fuel at 4.5 kg.

Consequently, similar effects to those in Embodiment 1 above can also be achieved in Embodiment 3.

Because the welded-disk bellows 44 is prepared by laminating disk-shaped flat springs 45 and alternately welding inner circumferential sides and an outer circumferential sides of adjacent flat springs 45 airtightly, the spring pressure of the welded-disk bellows 44 can be set structurally and accurately.

Because the spring pressure applying pressure to the fuel is applied by the welded-disk bellows 44, installation of a spring for applying pressure to the fuel is no longer necessary, enabling scaling down of the pressure accumulator 30B.

Moreover, in Embodiment 3 above, the welded-disk bellows 44 is prepared using stainless flat springs 45 but the material for the flat springs 45 is not limited to a stainless alloy, provided that it is a material having spring properties, and for example, phosphor bronze, red brass, beryllium copper, etc., can also be used.

Embodiment 4

Figure 7:
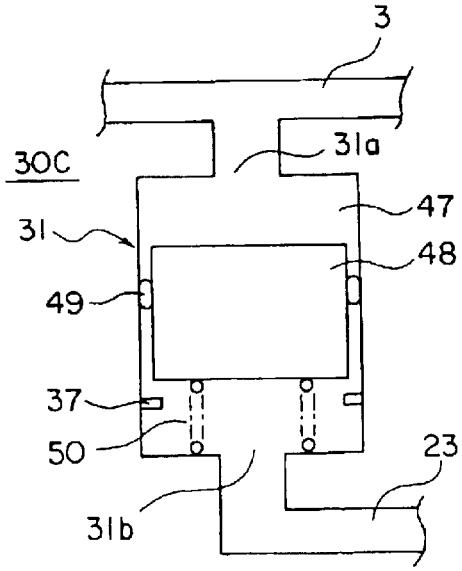
FIG. 7 is a schematic diagram showing a construction of a pressure accumulator of an automotive fuel supply apparatus according to Embodiment 4 of the present invention.

FIG. 7 is a schematic diagram showing a construction of a pressure accumulator of an automotive fuel supply apparatus according to Embodiment 4 of the present invention.

In FIG. 7, a pressure accumulator 30C is provided with: a tubular housing 31 (a cylinder) in which a first aperture 31*a* and a second aperture 31*b* are disposed; a piston 48 sidably disposed inside the housing 31 with an oil seal 49 interposed; and an accumulator spring 50 functioning as a pressure applying means for forcing the piston 48 toward the first aperture 31*a* disposed in a compressed state between the piston 48 and a bottom surface of the housing 31. Moreover, a region defined by the housing 31 and the piston 48 constitutes a storage chamber 47. A first stopper 37 mounted to an inner wall of the housing 31 engages the piston 48 to regulate a position of maximum expansion of the storage chamber 47. The pressure accumulator 30C is connected to the fuel distribution line 3 through the first aperture 31*a* and communicates with a portion of an intake air manifold 6 upstream from fuel injection valves 4 through the second aperture 31*b* and a communicating line 23.

The accumulator spring 50 is set such that the spring pressure when the storage chamber 47 is at the position of maximum expansion is 3 kg.

Moreover, except for the fact that the pressure accumulator 30C is used instead of the pressure accumulator 30, Embodiment 4 is constructed in a similar manner to Embodiment 1 above.

Next, characteristic portions of the operation of Embodiment 4 will be explained for a case in which the pressure inside the intake air manifold 6 is 1 kg.

First, the fuel distribution line 3 is filled with fuel at the maximum capacity of the fuel pump 1. Activation of the fuel pump 1 is stopped when the engine control apparatus 20 detects that the fuel pressure inside the fuel distribution line 3 has exceeded 4.6 kg. At this time, the storage chamber 47 of the pressure accumulator 30C is filled with fuel at 4.5 kg and at the position of maximum expansion.

Opening of the fuel injection valves 4 is controlled by the engine control apparatus 20 to supply fuel inside the fuel distribution line 3 to the engine 5. The fuel pressure inside the fuel distribution line 3 drops due to this fuel injection. When the fuel pressure inside the fuel distribution line 3 is equal to or less than 4 kg (the third set pressure), the fuel accumulated under pressure in the pressure accumulator 30C is supplied to the fuel distribution line 3 to compensate for the decrease due to fuel injection while the piston 48 moves toward the first aperture 31*a* and the storage chamber 47 of the pressure accumulator 30C contracts.

Then, when the engine control apparatus 20 detects that the fuel pressure inside the fuel distribution line 3 is 3.5 kg, the fuel pump 1 is reactivated to return the fuel distribution line 3 and the storage chamber 47 of the pressure accumulator 30C to the initial state filled with fuel at 4.5 kg.

Consequently, similar effects to those in Embodiment 1 above can also be achieved in Embodiment 4.

Embodiment 5

Figure 8:
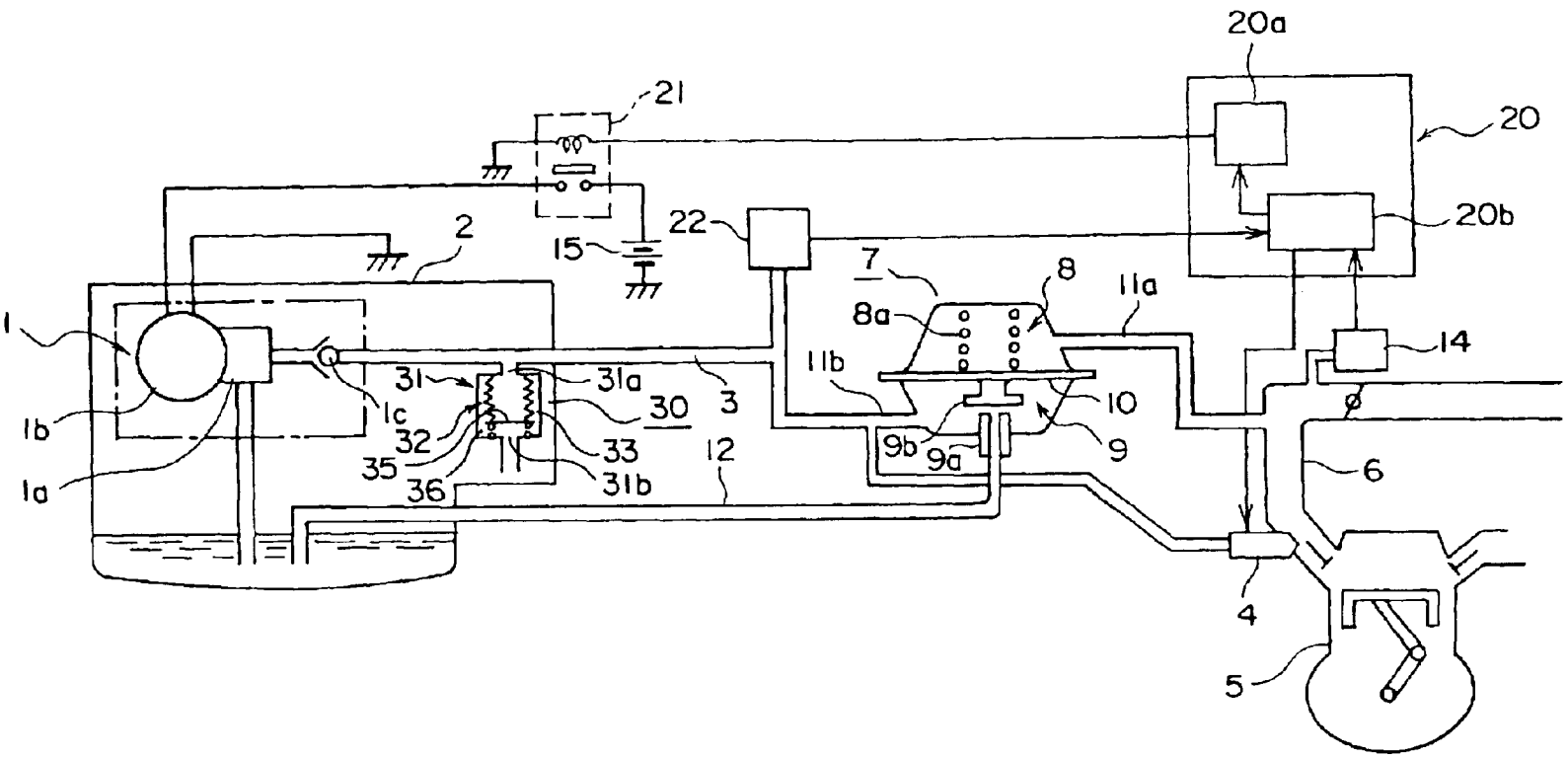
FIG. 8 is a schematic diagram showing a general overview of an automotive fuel supply apparatus according to Embodiment 5 of the present invention.

FIG. 8 is a schematic diagram showing a general overview of an automotive fuel supply apparatus according to Embodiment 5 of the present invention.

In FIG. 8, the pressure accumulator 30 is installed inside the fuel tank 2, the second aperture 31*b* of the housing 31 opening into the fuel tank 2. The second stopper 38 regulating the position of minimum contraction of the storage chamber 32 is removed.

Moreover, the rest of this embodiment is constructed in a similar manner to Embodiment 1 above.

Operation of the automotive fuel supply apparatus in various operating states of the engine will now be explained.

Because the second aperture 31*b* of the housing 31 of the pressure accumulator 30 opens into the fuel tank 2, the pressure in the storage chamber 32 is the sum of the spring pressure of the accumulator spring 36 and the pressure inside the fuel tank 2. The pressure inside the fuel tank 2 is generally equivalent to atmospheric pressure. Thus, in the operating state when the engine is at full throttle and the pressure $P_a$ inside the intake air manifold 6 is atmospheric pressure (1 kg), Embodiment 5 operates in a similar manner to Embodiment 1 above.

Next, the fuel pump 1 is activated when the operating state of the engine is such that the pressure $P_a$ inside the intake air manifold 6 is atmospheric pressure (1 kg), and if the pressure $P_a$ inside the intake air manifold 6 drops to 0.2 kg immediately after the storage chamber 32 of the pressure accumulator 30 is filled with fuel at 4.5 kg, the controlled pressure $P_0$ of the fuel pressure in the fuel pressure regulator 7 drops from 4.5 kg to 3.7 kg. Thus, the fuel pressure inside the fuel distribution line 3 drops from 4.5 kg to 3.7 kg, and the pressure of the fuel filling the storage chamber 32 similarly drops from 4.5 kg to 3.7 kg.

On the other hand, if the storage chamber 32 is at the position of maximum expansion, a pressure F equivalent to the sum (4 kg) of the spring pressure (3 kg) of the accumulator spring 36 and atmospheric pressure (1 kg) is applied to the storage chamber 32 through the end plate 35. Thus, the storage chamber 32 contracts until the pressure F becomes 3.7 kg. Fuel corresponding to the amount of this contraction in the storage chamber 32 flows out into the fuel distribution line 3 and flows back through the return line 12 into the fuel tank 2. The spring pressure of the accumulator spring 36 at this point in time is 2.7 kg.

If the opening and closing of the fuel injection valves 4 is continued in this state, fuel from inside the storage chamber 32 replenishes the fuel distribution line 3 for each fuel injection to compensate for the decrease in fuel due to injection. Then, when the fuel pressure inside the fuel distribution line 3 drops to the second set pressure $P_2$, the fuel pump 1 is activated to fill the fuel distribution line 3 and the storage chamber 32 of the pressure accumulator 30 with fuel at 3.7 kg. At the same time, the second set pressure $P_2$ is 2.7 kg (=2.5 kg+$P_a$). Thus, by the time the pressure $P_a$ inside the intake air manifold 6 drops to 0.2 kg, fuel corresponding to the amount of contraction of the storage chamber 32 due to the pressure F decreasing from 3.7 kg (the third set pressure) to 2.7 kg (approximately 200 cc), is accumulated under pressure in the storage chamber 32, preventing the occurrence of deficient injection quantities from the fuel injection valves 4.

On the other hand, if the fuel pump 1 is activated when the operating state of the engine is such that the pressure $P_a$ inside the intake air manifold 6 is 0.2 kg, the storage chamber 32 of the pressure accumulator 30 is filled with fuel at 3.7 kg because the controlled pressure $P_0$ of the fuel pressure in the fuel pressure regulator 7 is 3.7 kg. In that case, only 200 cc of fuel is accumulated under pressure in the storage chamber 32, but thereafter, fuel does not flow back into the fuel tank 2 through the return line 12 even if the pressure $P_a$ inside the intake air manifold 6 becomes atmospheric pressure. Thus, fuel inside the storage chamber 32 replenishes the fuel distribution line 3 to compensate for the decreases in fuel due to injection until the fuel pressure inside the fuel distribution line 3 drops to the second set pressure $P_2$ (3.5 kg), preventing the occurrence of deficient injection quantities from the fuel injection valves 4.

Thus, similar effects to those in Embodiment 1 above can also be achieved in Embodiment 5.

According to Embodiment 5, because the pressure accumulator 30 is disposed inside the fuel tank 2, it is possible to use clear space inside the fuel tank 2 to increase the size of the pressure accumulator 30, in other words, to increase the effective volume of the storage chamber 32. Thus, the period that the fuel pump 1 is stopped can be lengthened, enabling electric power loss to be further reduced.

Because the storage chamber 32 of the pressure accumulator 30 is constructed airtightly, fuel can be charged between an external portion of the storage chamber 32 and the housing 31. Thus, installing the pressure accumulator 30 inside the fuel tank 2 does not lead to reduced capacity in the fuel tank 2.

If the external portion of the storage chamber 32 were an airtight space, the pressure F might fluctuate from the design value as a result of volume shifts in the storage chamber 32, or the function of the pressure accumulator might be lost if the airtight space were filled with fuel in an unforeseen situation. However, these kinds of problems are eliminated because the housing 31*b* is open to the fuel tank 2.

Furthermore, since the pressure changes inside the intake air manifold 6 due to the operating state of the natural air-intake engine 5 range from 1 kg to 0.2 kg, in the worst cases, as mentioned above, the utilization factor of effective volume of the pressure accumulator 30 (the storage chamber 32) may be reduced to forty percent, but this will not significantly undermine the reductions in fuel consumption obtained by the construction of the present application which stops the fuel pump 1.

Now, in Embodiment 5 above, the pressure inside the intake air manifold 6 is explained as being introduced into the spring chamber 8 of the fuel pressure regulator 7, but the spring chamber 8 of the fuel pressure regulator 7 may also be open to the atmosphere. In that case, the utilization factor of effective volume of the pressure accumulator 30 (the storage chamber 32) can be increased to 100 percent.

In Embodiment 5 above, the second aperture 31*b* of the housing 31 of the pressure accumulator 30 is explained as opening into the fuel tank 2, but the second aperture 31*b* of the housing 31 may also communicate with a portion of the intake air manifold 6 upstream from the fuel injection valves 4 through a communicating line. In that case, Embodiment 5 operates in a similar manner to Embodiment 1 above.

In Embodiment 5 above, the spring constant of the accumulator spring 36 is explained as being linear, but the accumulator spring 36 may also be prepared such that the spring constant is nonlinear in such a way that the quantity of flowback from the storage chamber 32 of the pressure accumulator 30 to the fuel tank 2 arising when the pressure $P_a$ inside the intake air manifold 6 drops from atmospheric pressure to 0.2 kg is reduced. In that case, the quantity of fuel with which the storage chamber 32 can replenish the fuel distribution line 3 can be increased by reducing the pressure F of the accumulator spring 36 from the third set pressure to the second set pressure, enabling the period that the fuel pump 1 is stopped to be lengthened.

The present invention is constructed in the above manner and exhibits the effects described below.

As explained above, according to one aspect of the present invention, there is provided an automotive fuel supply apparatus including:

a fuel pump for conveying fuel under pressure from inside a fuel tank, the fuel pump including a check valve;

a fuel distribution line for connecting the fuel pump and a fuel injection valve of an engine;

a fuel pressure regulator connected to the fuel distribution line for controlling fuel pressure in the fuel distribution line so as to be at a controlled pressure;

a pressure accumulator disposed on the fuel distribution line for accumulating pressure in the fuel conveyed under pressure to the fuel distribution line;

a pressure detector for measuring fuel pressure inside the fuel distribution line; and a pump controlling means for controlling activation of the fuel pump in response to output from the pressure detector, thereby providing an inexpensive automotive fuel supply apparatus enabling electric power losses to be reduced by reducing unnecessary fuel discharge from the fuel pump, and also enabling the suppression of undesirable emission of radio waves and the occurrence of excessive Joule loss.

There may be provided a fuel correcting means for calculating a quantity of fuel supply to the engine based on a pressure difference between the fuel pressure inside the fuel distribution line obtained from the output from the pressure detector and pressure inside an intake air manifold of the engine, the fuel correcting means controlling a valve opening time of the fuel injection valve so as to obtain the calculated quantity of fuel supply, enabling accurate fuel injection to be performed.

The pump controlling means may be constructed such that activation of the fuel pump is switched off when the output from the pressure detector is a first set pressure, and activation of the fuel pump is switched on when the output from the pressure detector is a second set pressure which is less than the first set pressure and the controlled pressure of the fuel pressure regulator, preventing an injection quantity from the fuel injection valve from being deficient even if a delay occurs due to the startup characteristics of the motor portion of the fuel pump.

The pressure accumulator may be provided with:

a storage chamber disposed so as to communicate with the fuel distribution line, the storage chamber being filled with fuel flowing in from the fuel distribution line and being constructed such that an internal volume thereof is variable by expanding and contracting in a central axial direction in response to the fuel pressure; and a pressure applying means for delivering fuel from inside the storage chamber to the fuel distribution line by compressing the storage chamber during a process of the fuel pressure inside the fuel distribution line decreasing from a third set pressure to the second set pressure, the third set pressure being less than at least one of the first set pressure and the controlled pressure of the fuel pressure regulator and greater than the second set pressure, avoiding deficiencies in the injection quantity from the fuel injection valve.

The storage chamber may be constructed such that a modulus of elasticity in a central axial direction of the storage chamber and a modulus of elasticity in a direction perpendicular to the central axial direction are different, enabling the pressure accumulator to be achieved by a simple construction.

The storage chamber may be composed of at least two members having different moduli of elasticity, enabling the pressure accumulator to be achieved by a simple construction.

The storage chamber may be constituted by:

a cylinder;

a piston disposed inside the cylinder; and an oil seal interposed between the cylinder and the piston, enabling the pressure accumulator to be achieved by a simple construction.

The pressure accumulator may have a storage chamber disposed so as to communicate with the fuel distribution line, the storage chamber being filled with fuel flowing in from the fuel distribution line and being constructed such that an internal volume thereof is variable by expanding and contracting in a central axial direction in response to the fuel pressure, the storage chamber being provided with a pressure applying force for delivering fuel from inside the storage chamber to the fuel distribution line by contracting during a process of the fuel pressure inside the fuel distribution line decreasing from a third set pressure to the second set pressure, the third set pressure being less than at least one of the first set pressure and the controlled pressure of the fuel pressure regulator and greater than the second set pressure, avoiding deficiencies in the injection quantity from the fuel injection valve, and enabling reductions in size by eliminating the need to install a pressure applying means.

The pressure accumulator may be constructed such that pressure inside an engine intake air manifold acts in a direction compressing the storage chamber, enabling the utilization factor of the effective volume of the storage chamber to be increased to 100 percent.

The pressure accumulator may be disposed inside the fuel tank, enabling increases in the size of the pressure accumulator, thereby enabling the period that the fuel pump is stopped to be lengthened.

The pressure accumulator may be disposed inside an engine compartment, simplifying maintenance of the pressure accumulator.

What is claimed is:

1. An automotive fuel supply apparatus comprising:

a fuel pump for conveying fuel under pressure from inside a fuel tank, said fuel pump including a check valve;

a fuel distribution line for connecting said fuel pump and a fuel injection valve of an engine;

a fuel pressure regulator connected to said fuel distribution line for controlling fuel pressure in said fuel distribution line so as to be at a controlled pressure;

a pressure accumulator disposed on said fuel distribution line for accumulating pressure in said fuel conveyed under pressure to said fuel distribution line;

a pressure detector for measuring fuel pressure inside said fuel distribution line; and a pump controlling means for controlling activation of said fuel pump in response to output from said pressure detector, wherein said pump controlling means is constructed such that activation of said fuel pump is switched off when said output from said pressure detector is a first set pressure, and activation of said fuel pump is switched on when said output from said pressure detector is a second set pressure which is less than said first set pressure and said controlled pressure of said fuel pressure regulator.

2. The automotive fuel supply apparatus according to claim 1, wherein said pressure accumulator is provided with:

a storage chamber disposed so as to communicate with said fuel distribution line, said storage chamber being filled with fuel flowing in from said fuel distribution line and being constructed such that an internal volume thereof is variable by expanding and contracting in a central axial direction in response to said fuel pressure; and a pressure applying means for delivering fuel from inside said storage chamber to said fuel distribution line by compressing said storage chamber during a process of said fuel pressure inside said fuel distribution line decreasing from a third set pressure to said second set pressure, said third set pressure being less than at least one of said first set pressure and said controlled pressure of said fuel pressure regulator and greater than said second set pressure.

3. The automotive fuel supply apparatus according to claim 2, wherein said storage chamber is constructed such that a modulus of elasticity in a central axial direction of said storage chamber and a modulus of elasticity in a direction perpendicular to said central axial direction are different.

4. The automotive fuel supply apparatus according to claim 2, wherein said storage chamber is composed of at least two members having different moduli of elasticity.

5. The automotive fuel supply apparatus according to claim 2, wherein said storage chamber is constituted by:

a cylinder;

a piston disposed inside said cylinder; and an oil seal interposed between said cylinder and said piston.

6. The automotive fuel supply apparatus according to claim 2, wherein said pressure accumulator is constructed such that pressure inside an engine intake air manifold acts in a direction compressing said storage chamber.

7. The automotive fuel supply apparatus according to claim 1, wherein said pressure accumulator has a storage chamber disposed so as to communicate with said fuel distribution line, said storage chamber being filled with fuel flowing in from said fuel distribution line and being constructed such that an internal volume thereof is variable by expanding and contracting in a central axial direction in response to said fuel pressure, said storage chamber being provided with a pressure applying force for delivering fuel from inside said storage chamber to said fuel distribution line by contracting during a process of said fuel pressure inside said fuel distribution line decreasing from a third set pressure to said second set pressure, said third set pressure being less than at least one of said first set pressure and said controlled pressure of said fuel pressure regulator and greater than said second set pressure.

8. The automotive fuel supply apparatus according to claim 7, wherein said pressure accumulator is constructed such that pressure inside an engine intake air manifold acts in a direction compressing said storage chamber.

9. The automotive fuel supply apparatus according to claim 1, further comprising a fuel correcting means for calculating a quantity of fuel supply to said engine based on a pressure difference between said fuel pressure inside said fuel distribution line obtained from said output from said pressure detector and pressure inside an intake air manifold of said engine, said fuel correcting means controlling a valve opening time of said fuel injection valve so as to obtain said calculated quantity of fuel supply.

10. The automotive fuel supply apparatus according to claim 1, wherein said pressure accumulator is disposed inside said fuel tank.

11. The automotive fuel supply apparatus according to claim 1, wherein said pressure accumulator is disposed inside an engine compartment.

* * * * *